US012264472B2

(12) United States Patent
Sherwood

(10) Patent No.: US 12,264,472 B2
(45) Date of Patent: Apr. 1, 2025

(54) CATCH BASIN SYSTEM AND CORRESPONDING WATER DRAINAGE SYSTEM

(71) Applicant: Robert Sherwood, Almont, MI (US)

(72) Inventor: Robert Sherwood, Almont, MI (US)

( * ) Notice: Subject to any disclaimer, the term of this patent is extended or adjusted under 35 U.S.C. 154(b) by 57 days.

(21) Appl. No.: 18/462,027

(22) Filed: Sep. 6, 2023

(65) Prior Publication Data

US 2024/0309626 A1 Sep. 19, 2024

Related U.S. Application Data

(63) Continuation-in-part of application No. 18/185,648, filed on Mar. 17, 2023.

(51) Int. Cl.
*E03F 5/10* (2006.01)
*E03F 1/00* (2006.01)

(52) U.S. Cl.
CPC ..... *E03F 5/10* (2013.01); *E03F 1/002* (2013.01)

(58) Field of Classification Search
CPC ..... E02B 11/00; E02B 11/005; E02B 13/00; E03F 5/021; E03F 5/027; E03F 5/043; E03F 5/0403
See application file for complete search history.

(56) References Cited

U.S. PATENT DOCUMENTS 3,670,894 A 6/1972 Friedl
3,695,153 A 10/1972 Dorris
4,031,009 A 6/1977 Hicks
4,988,235 A * 1/1991 Hurley ..... E01C 13/02 405/36
6,112,935 A 9/2000 Shackelford
6,416,667 B1 7/2002 Graves
6,669,405 B1 12/2003 Rhodes
6,837,652 B1 1/2005 Rost et al.
7,303,357 B2 12/2007 Villarreal et al.
7,540,953 B2 6/2009 Fitzgerald
7,651,297 B2 1/2010 Villareal et al.
7,661,904 B2 2/2010 Maggiacomo
10,323,778 B2 6/2019 Rusch
10,669,708 B1 6/2020 Sherwood
10,704,246 B2 7/2020 Roseen
10,968,616 B1 4/2021 Smith et al.
10,968,618 B1 4/2021 Sherwood
10,982,423 B1 4/2021 Sherwood
(Continued)

FOREIGN PATENT DOCUMENTS

KR 102018992 B1 * 11/2019
KR 102456163 B1 10/2022

*Primary Examiner* — Frederick L Lagman
(74) *Attorney, Agent, or Firm* — Brooks Kushman P.C.

(57) ABSTRACT

A catch basin system includes a first tube, a second tube, a basin, and an access port. The first tube is aligned along a first axis. The second tube is aligned along a second axis. The basin is disposed between opposing ends of the first and second tubes. The basin intersects the first and second tubes. The basin extends downward from the first and second tubes. The access port is aligned along a third axis. The access port is disposed above the basin. The access port is disposed between opposing ends of the first and second tubes. The access port intersects the first and second tubes. The access port extends upward from the first and second tubes. The access port is configured to provide access to the basin.

20 Claims, 12 Drawing Sheets

(56) References Cited

U.S. PATENT DOCUMENTS

| | | | | |
|---|---|---|---|---|
| 2004/0128903 | A1 | 7/2004 | Wexler | |
| 2007/0177941 | A1 | 8/2007 | Villarreal et al. | |
| 2008/0085157 | A1 | 4/2008 | Villarreal et al. | |
| 2022/0243448 | A1 | 8/2022 | Peters, Jr. | |
| 2022/0299145 | A1* | 9/2022 | Recchia | E03F 5/021 |
| 2024/0309626 | A1 | 9/2024 | Sherwood | |
| 2024/0309627 | A1 | 9/2024 | Sherwood | |

* cited by examiner

CATCH BASIN SYSTEM AND CORRESPONDING WATER DRAINAGE SYSTEM

CROSS-REFERENCE TO RELATED APPLICATIONS

This application is a continuation-in-part of U.S. patent application Ser. No. 18/185,648 filed on Mar. 17, 2023, the disclosure of which is hereby incorporated in its entirety by reference herein.

TECHNICAL FIELD

The present disclosure relates to water drainage systems, particularly to water drainage systems for buildings and houses.

BACKGROUND

Runoff water may be directed away from buildings and houses via water drainages systems.

SUMMARY

A catch basin system includes a first conduit, a second conduit, a third conduit, a fourth conduit, a basin, and an access port. The first conduit is aligned along a first horizontal axis. The second conduit is spaced-apart from the first conduit. The second conduit is aligned along the first horizontal axis. The third conduit is aligned along a second horizontal axis. The fourth conduit is spaced-apart from the third conduit. The fourth conduit is aligned along the second horizontal axis. The basin is disposed between the first and second conduits. The basin is disposed between the third and fourth conduits. The basin extends downward from the first, second, third, and fourth conduits. The access port is aligned along a vertical axis. The access port is disposed above the basin. The access port is disposed between the first and second conduits. The access port is disposed between the third and fourth conduits. The access port extends upward from the first, second, third, and fourth conduits. The access port is configured to provide access to the basin.

A catch basin system includes a first tube, a second tube, a basin, and an access port. The first tube is aligned along a first axis. The second tube is aligned along a second axis. The basin is disposed between opposing ends of the first and second tubes. The basin intersects the first and second tubes. The basin extends downward from the first and second tubes. The access port is aligned along a third axis. The access port is disposed above the basin. The access port is disposed between opposing ends of the first and second tubes. The access port intersects the first and second tubes. The access port extends upward from the first and second tubes. The access port is configured to provide access to the basin.

A catch basin includes a housing. The housing defines a first channel, a second channel, a sump, and an access port. The first channel extends between opposing ends of the housing. The second channel extends between the opposing ends of the housing. The second channel is spaced-apart from the first channel. The sump is disposed between the opposing ends of housing. The sump intersects the first and second channels. The sump extends downward from the first and second channels. The access port is disposed between the opposing ends of the housing. The access port intersects the first and second channels. The access port is disposed above the sump. The access port extends upward from the first and second channels. The access port is configured to provide access to the sump.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
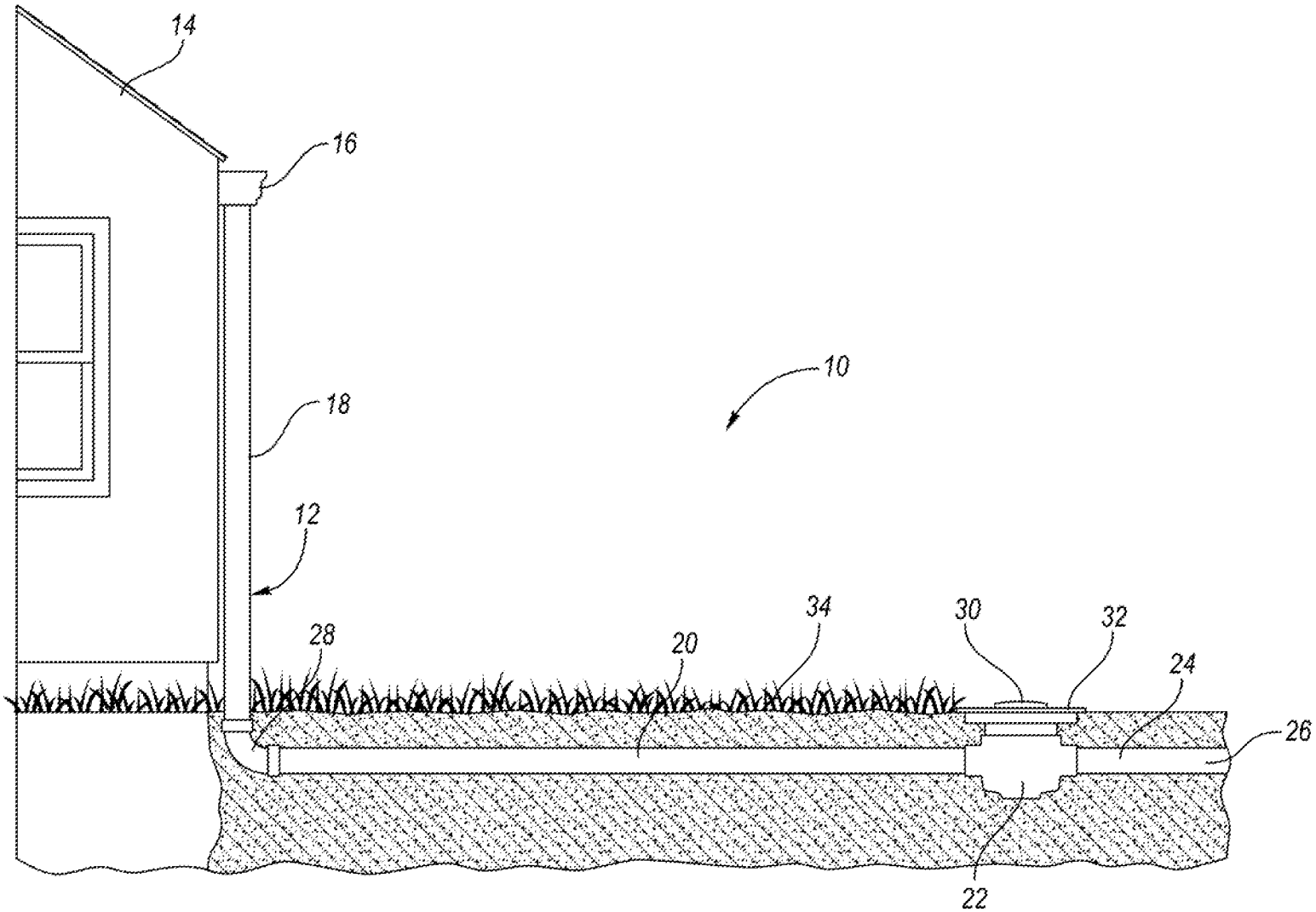
FIG. 1 is a front view of a water drainage system for a building or house.
Figure 2:
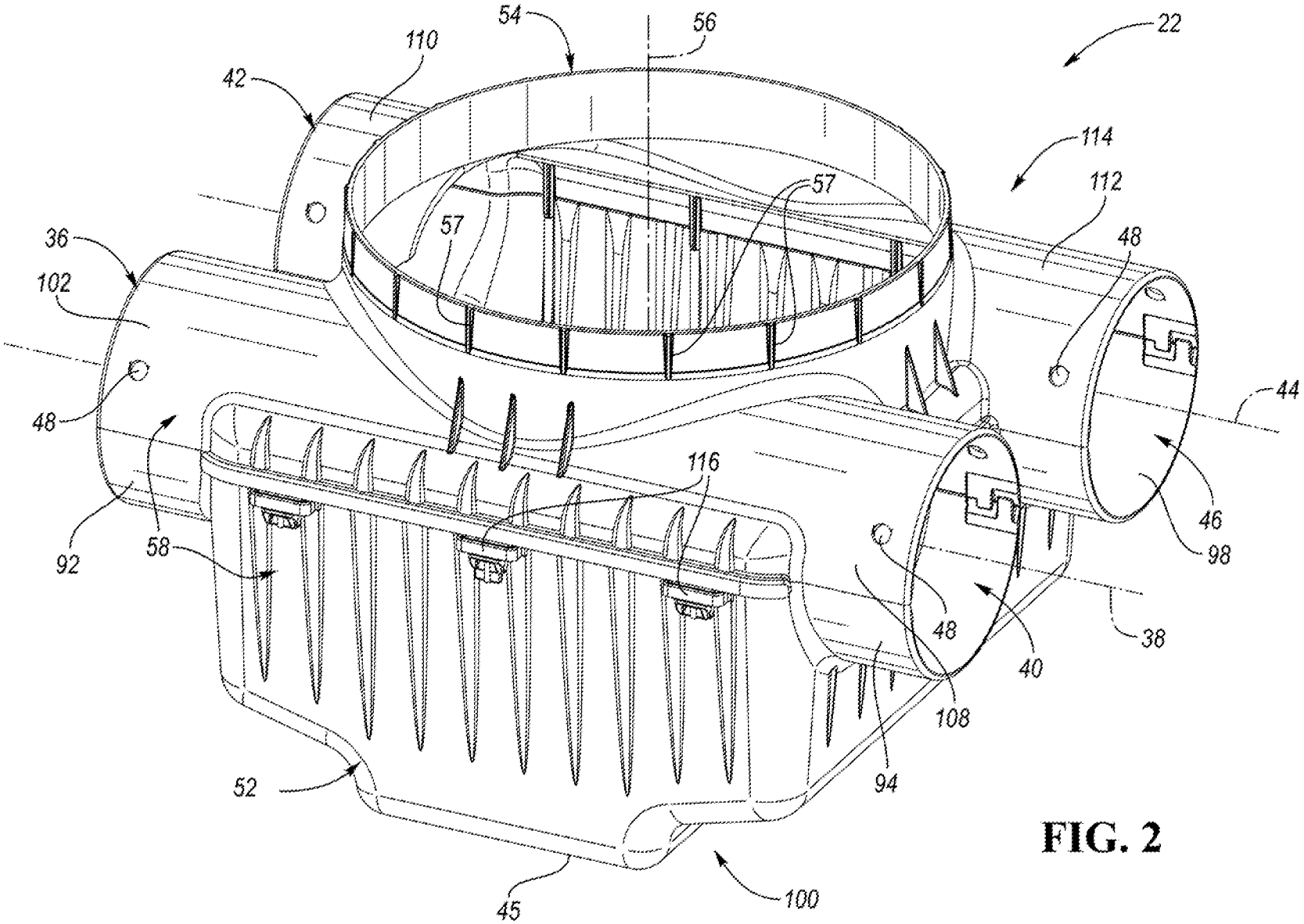
FIG. 2 is a front-top isometric view of a catch basin system.
Figure 3:
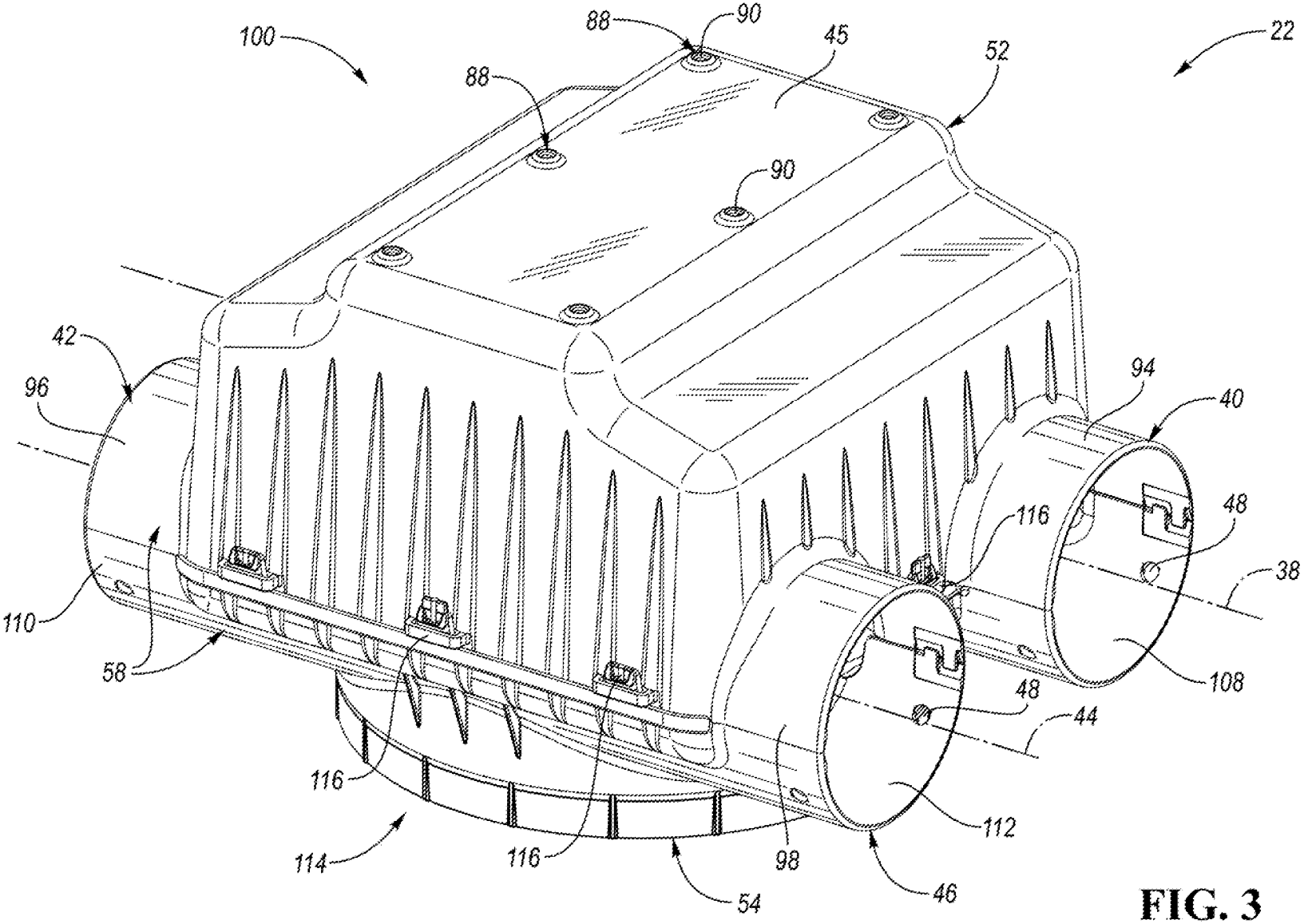
FIG. 3 is a front-bottom isometric view of the catch basin system.
Figure 4:
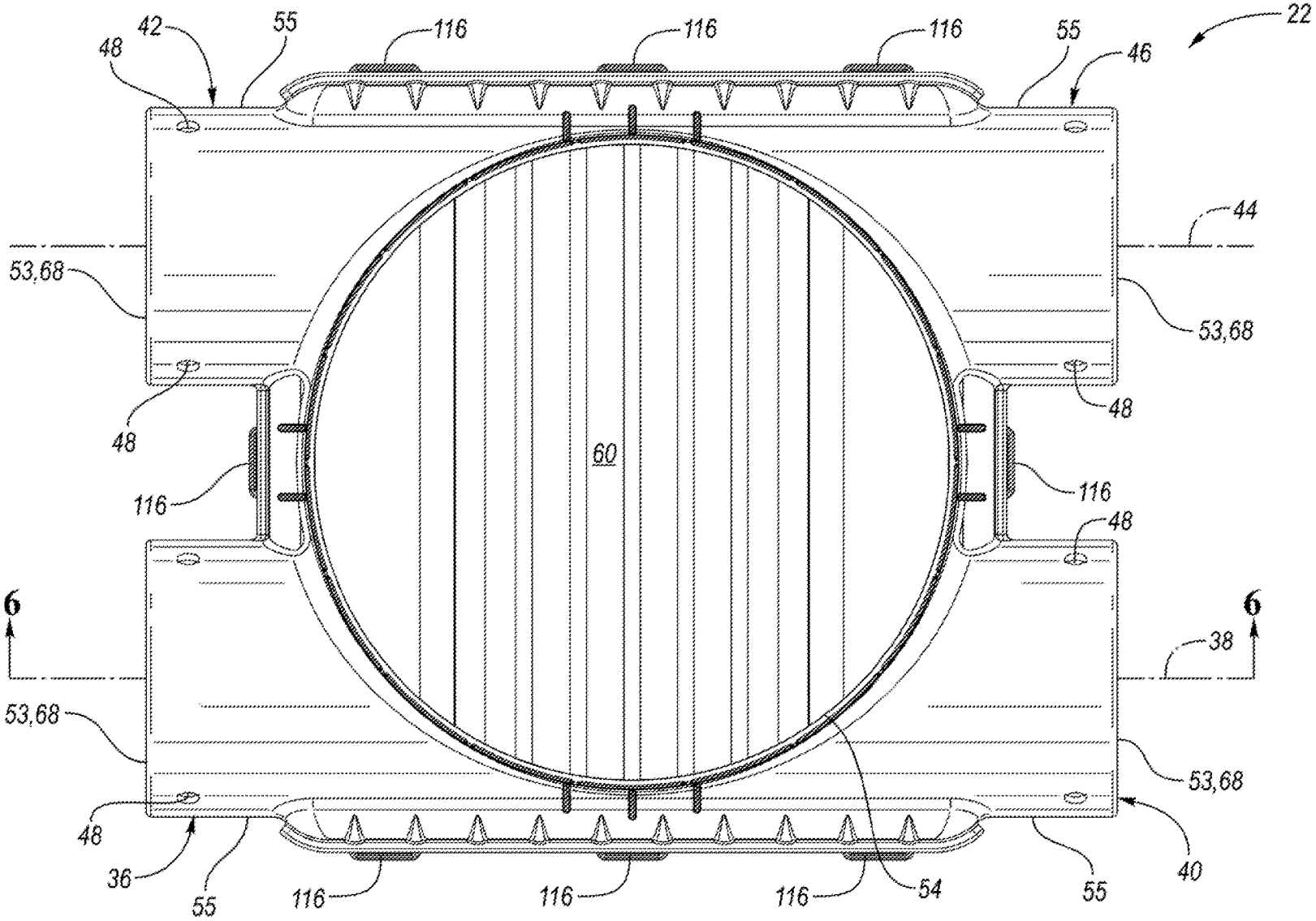
FIG. 4 is a top view of the catch basin system.
Figure 5:
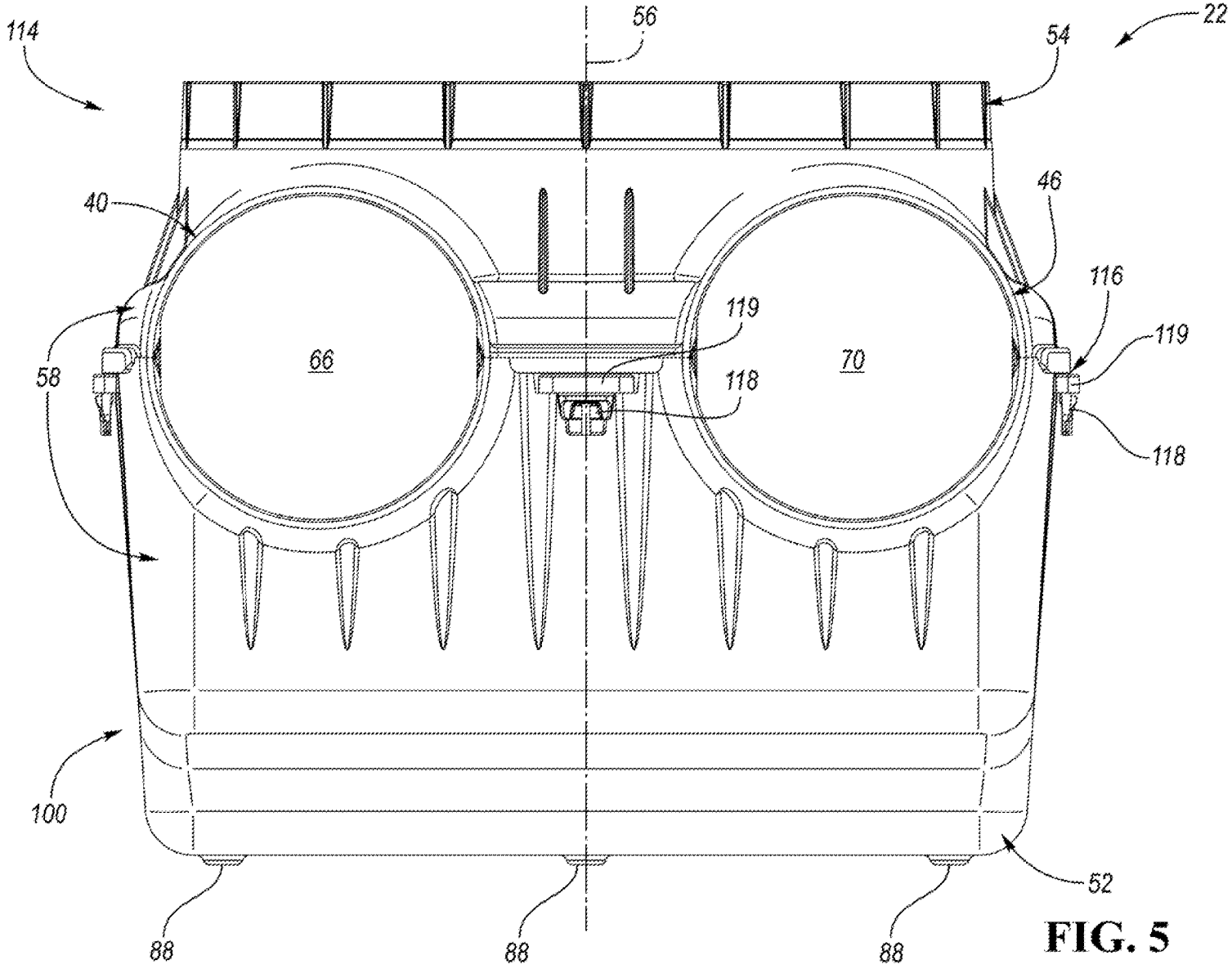
FIG. 5 is a side view of the catch basin system.
Figure 6:
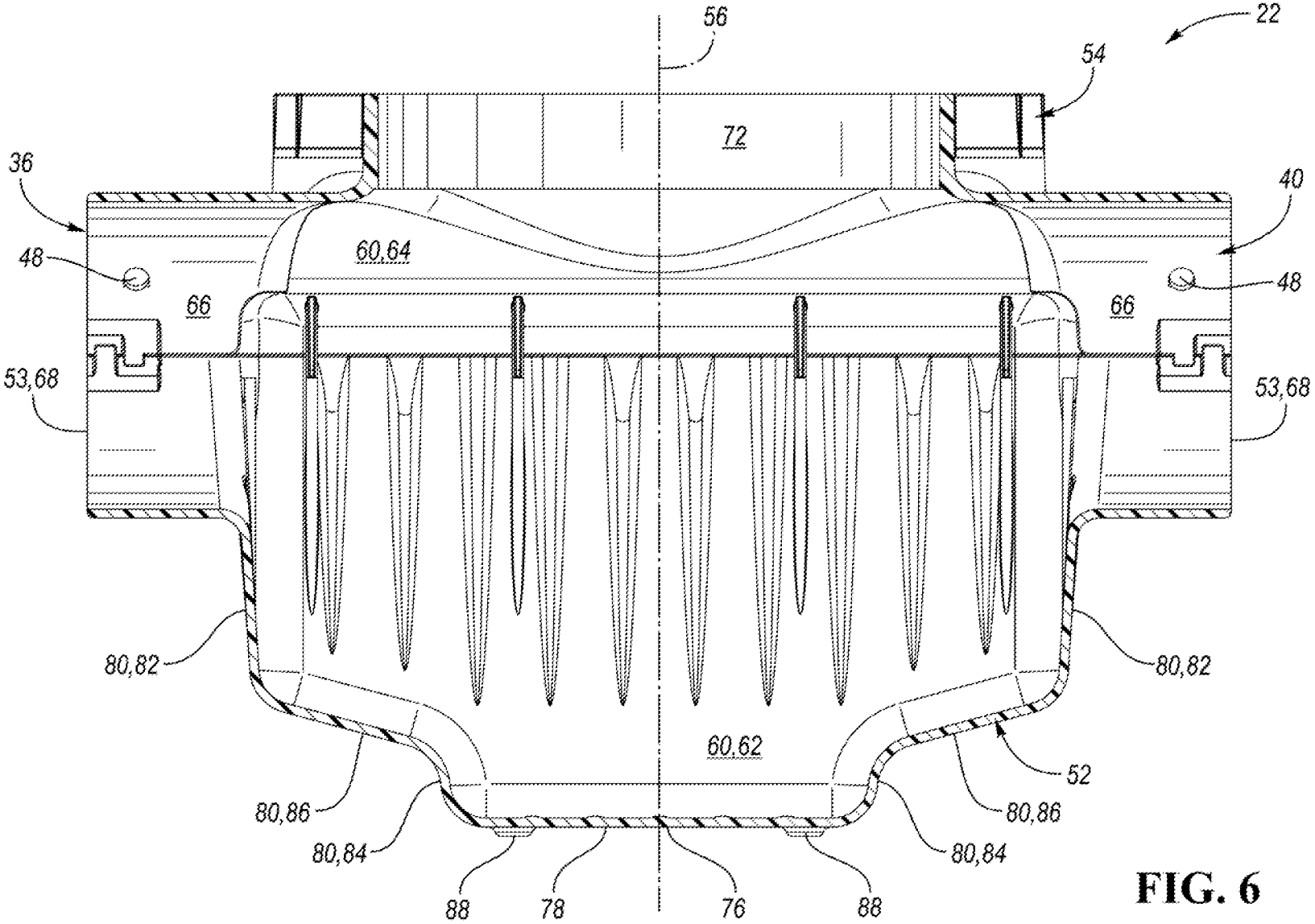
FIG. 6 is a cross-sectional view taken along line 6-6 in FIG. 4.

Referring to FIG. 1, a water drainage system 10 is illustrated. The water drainage system 10 may specifically be designed to direct water away from a house or building in order to prevent runoff water from the house or building from flooding the lower level (e.g., the basement) of the house or building. It should be understood, however, that the water drainage system 10 may be utilized in other scenarios and should not be construed as limited to a water drainage system that is configured to direct water away from a house or building.

As illustrated in FIG. 1, the water drainage system 10 includes tubes, pipes, or conduits 12 that are configured to direct water away from a house or building 14. More specifically, the conduits 12 may be configured to direct water away from an eavestrough 16 that is disposed along edges of a roof of the building 14. The eavestrough 16 is configured to collect runoff water that cascades down the roof of the building 14 during rainstorms, from melting snow, or from any other source. The conduits 12 are configured to direct the water away from the eavestrough 16 and away from the building 14.

The tubes, pipes, or conduits 12 of the water drainage system 10 may include a downspout 18 that is configured to direct water downward from the eavestrough 16 to a horizontal tube, pipe, or conduit 20. The horizontal conduit 20 in turn may be configured to direct water from the downspout 18 to a catch basin system 22. The catch basin system 22 may be an in-line catch basin that is sandwiched been the horizontal conduit 20 and a second horizontal conduit 24 or some other connection. The catch basin system 22 may be directly connected the horizontal conduit 20 and second horizontal conduit 24. Alternatively, the catch basin system 22 may be connected to the horizontal conduit 20 or the second horizontal conduit 24 via intermediate components or connecting parts such as reducing couplers, elbows, corrugate tube couplers, or any other desirable intermediate component or connecting part. If no connection is desired, a plug; a solid cap or cover; or a grate or grated cover may be disposed along the horizontal ends of the catch basin system 22 where the horizontal conduit 20 and second horizontal conduit 24 are shown to be connected to the catch basin system 22 in FIG. 1. The horizontal conduit 20 and second horizontal conduit 24 may include a slight downward slope extending in a direction from the downspout 18 toward an outlet end 26 of the water drainage system 10 such that water flows from the downspout 18 to the outlet end 26 of the water drainage system 10.

The downspout 18 may be connected to the horizontal conduit 20 via a first elbow tube, pipe, or conduit 28. The horizontal tube 20 and the first elbow conduit 28 may be disposed or buried underground, which may be for aesthetic purposes or may be to prevent placing an obstacle on an area of ground that may require maintenance (e.g., the area of ground may include grass that needs to be mowed on a regular basis) or that may have a significant amount of foot traffic.

An accessing component 30 is configured to provide access to, act as an inlet to, or act as an outlet from an internal cavity defined by the catch basin system 22. More specifically, the accessing component may be coupled to an access port (access port 54) of the catch basins system 22. The accessing component 30 could also be a plug that requires removal to provide access to the internal cavity defined by the catch basin system 22. The accessing component may be secured to an access port along the top of the catch basin system 22. The accessing component 30 may be directly secured to the access port along the top of the catch basin system 22. Alternatively, the accessing component 30 may be secured to the access port along the top of the catch basin system 22 via intermediate components or connecting parts such as a straight pipe that operates as riser, a reducing coupler, a corrugated tube coupler, or any other desirable intermediate component or connecting part. This may be required if there is a sufficient distance between the catch basin system 22 and the accessing component 30. For example, the catch basin system 22 may be buried below the ground, the accessing component 30 may be disposed above ground or at ground level, and there may be a sufficient distance between the catch basin 22 system and the accessing component 30 such that a direct connection between the catch basin system 22 and the accessing component 30 is not possible. The accessing component 30 may be a solid cap or cover; a plug, a pop-up drain emitter; a grate or grated cover; or any or any other desirable component. For example, the accessing component 30 could be an additional conduit that attaches the catch basin system to other components.

A turf cover 32 may be disposed radially about the accessing component 30. The turf cover 32 may also be disposed above and adjacent to the upper surface of the ground. The turf cover 32 may be configured to engage the ground to inhibit vegetative growth (e.g., grass 34) proximate to and radially about an outer periphery of the accessing component 30. More specifically, the turf cover 32 may cover the ground such that sunlight is unable to penetrate the ground directly below the turf cover 32, which inhibits the vegetative growth. The accessing component 30 and the turf cover 32 may both be green in order to blend in with the adjacent vegetation, or more specifically with the adjacent grass, which may be for aesthetic purposes.

Referring to FIGS. 2-7, the catch basin system 22 is illustrated in further detail. The catch basin system 22 includes a first tube or conduit 36 that is aligned and/or extends along a first axis 38. The catch basin 22 system includes a second tube or conduit 40 that is spaced-apart from the first conduit 36. The second conduit 40 is also aligned and/or extends along the first axis 38. The first axis 38 may be a substantially horizontal axis (i.e., the first axis 38 may extend in a horizontal direction). Substantially horizontal may refer to any incremental angle that is between exactly horizontal and 15° from exactly horizontal. At least one of the first conduit 36 and second conduit 40 may be an inlet to the catch basin system 22. At least one of the first conduit 36 and second conduit 40 may be an outlet to the catch basin system 22. The first conduit 36 and second conduit 40 may collectively form a single tube or conduit that is intersected by an intermediate component (e.g., the basin 52 or access port 54) and may be collectively referred to as the first conduit or tube.

The catch basin system 22 includes a third tube or conduit 42 that is aligned and/or extends along a second axis 44. The catch basin system 22 includes a fourth tube or conduit 46 that is spaced-apart from the third conduit 42. The fourth conduit 46 is also aligned and/or extends along the second axis 44. The second axis 44 may be a substantially horizontal axis (i.e., the second axis 44 may extend in a horizontal direction). Substantially horizontal may refer to any incremental angle that is between exactly horizontal and 15° from exactly horizontal. At least one of the third conduit 42 and fourth conduit 46 may be an inlet to the catch basin system 22. At least one of the third conduit 42 and fourth conduit 46 may be an outlet to the catch basin system 22. The third conduit 42 and fourth conduit 46 may collectively form a single tube or conduit that is intersected by an intermediate component (e.g., the basin 52 or access port 54) and may be collectively referred to as the second conduit or tube.

The first axis 38 may be substantially parallel with the second axis 44. Substantially parallel may refer to any incremental angle that is between exactly parallel and 15° from exactly parallel. The first axis 38 and the second axis 44 may be aligned vertically (e.g., the first axis 38 and the second axis 44 may be separated from a bottom or bottom end 45 of the catch basin system 22 by an equal distance) and may be spaced-apart from each other horizontally (e.g., the first axis 38 and the second axis 44 may be spaced apart from each other along a horizontal axis that is perpendicular to both the first axis 38 and the second axis 44).

Figure 7:
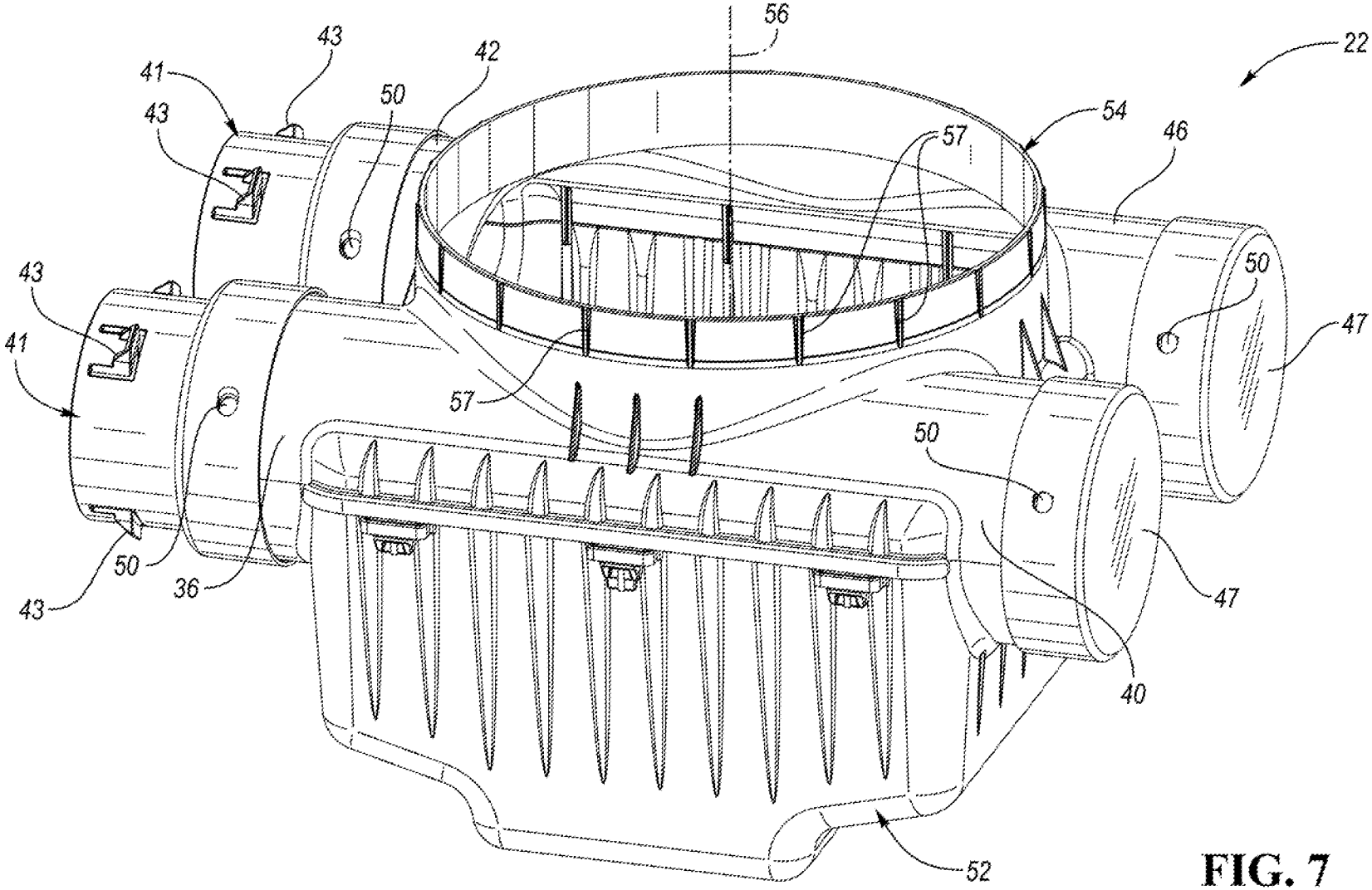
FIG. 7 is a front-top isometric view of the catch basin system having couplers and caps attached thereto.
Figure 8:
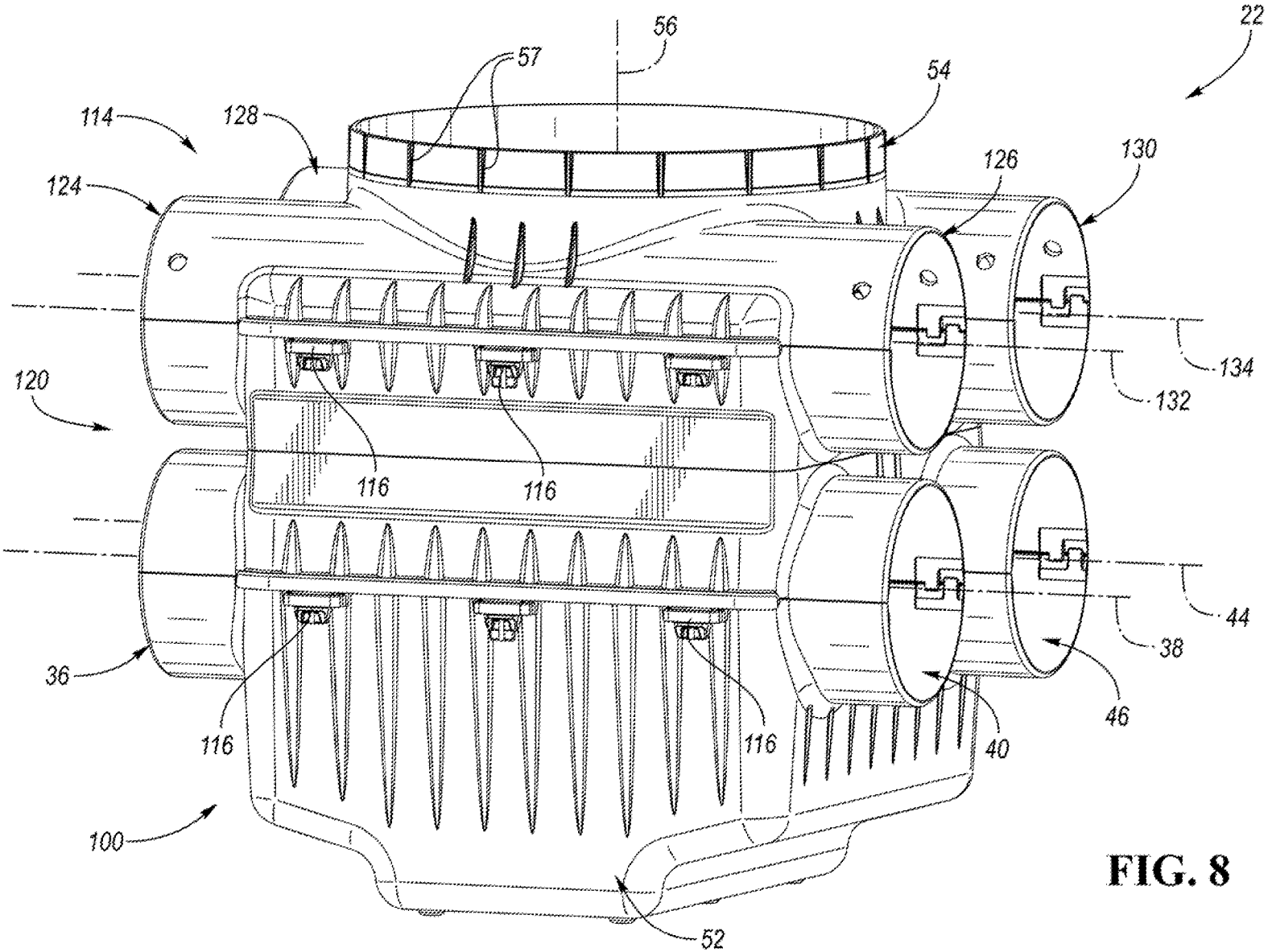
FIG. 8 is a front-top isometric view of the catch basin system with the addition of an adapter.
Figure 9:
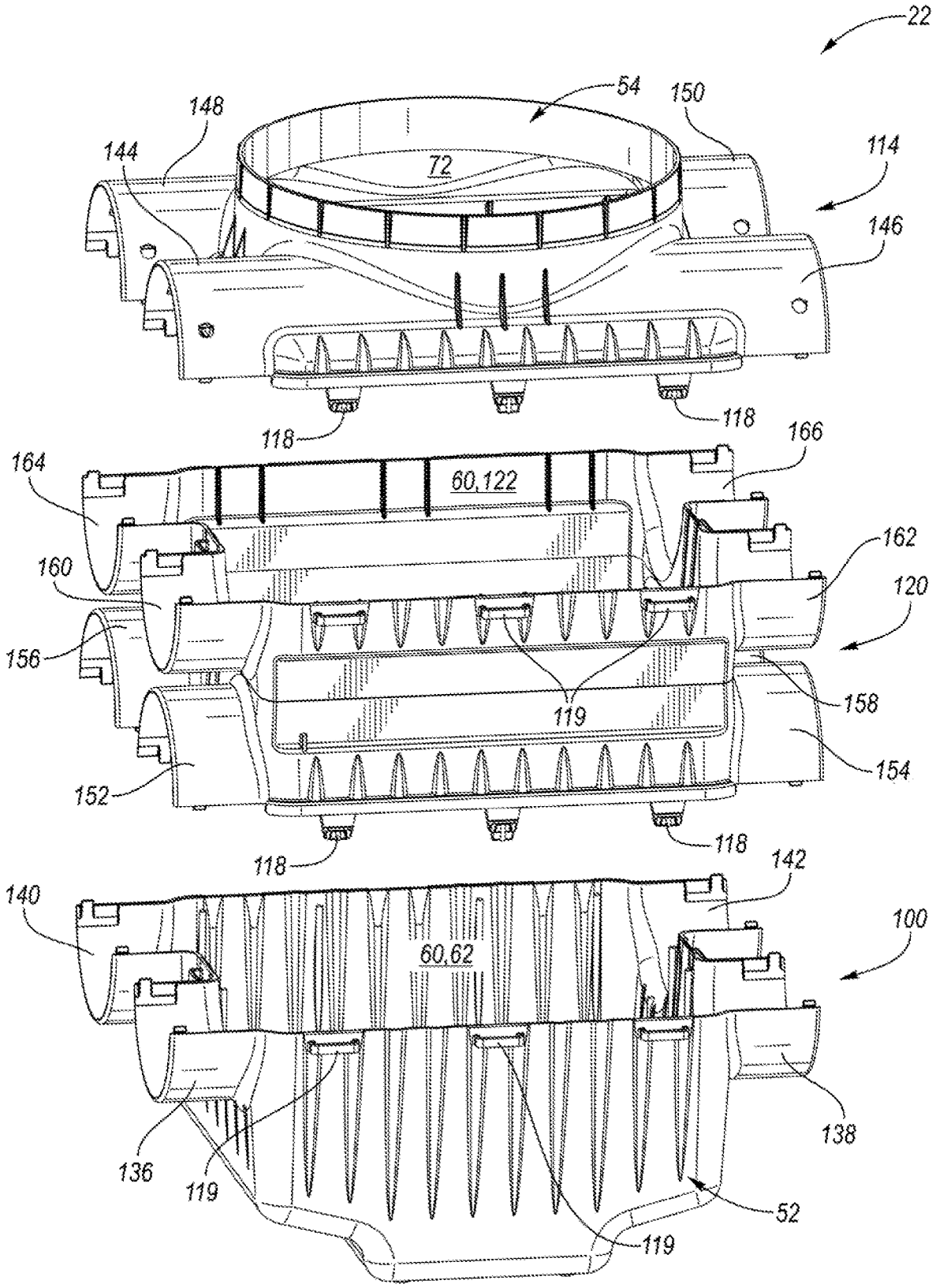
FIG. 9 is an exploded view the catch basin system including the adapter.
Figure 10:
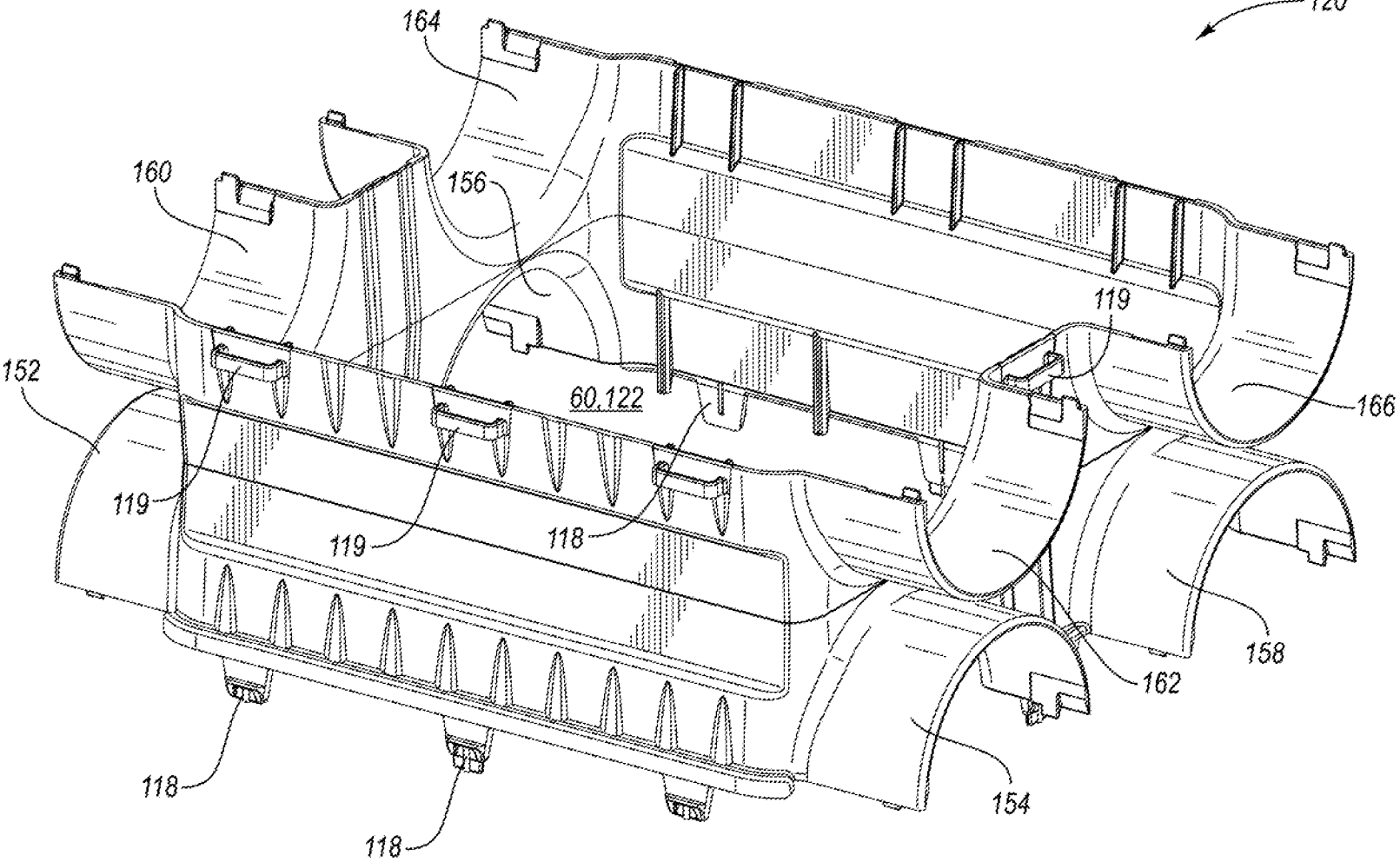
FIG. 10 is a front-top isometric view of the adapter.
Figure 11:
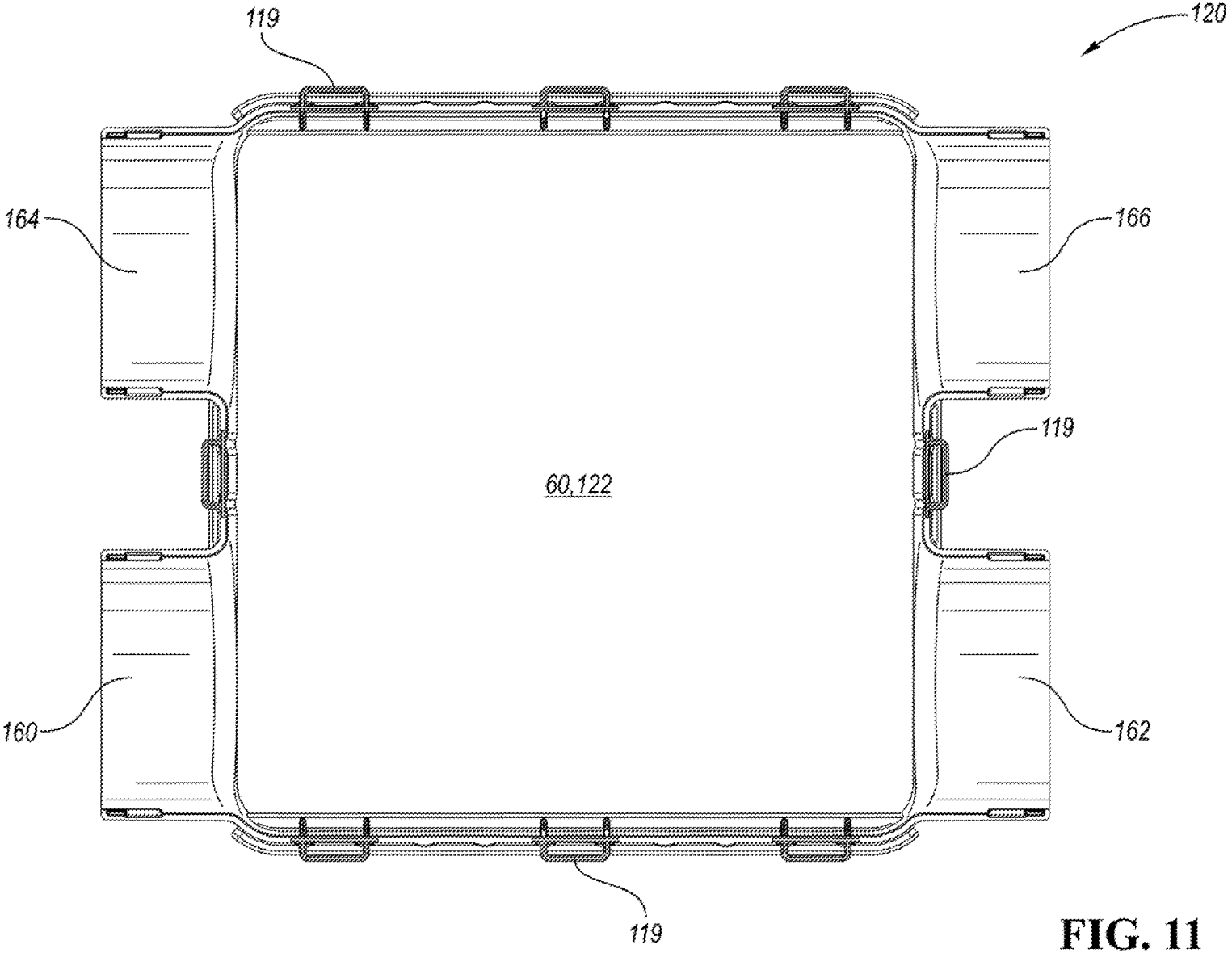
FIG. 11 is a top view of the adapter.
Figure 12:
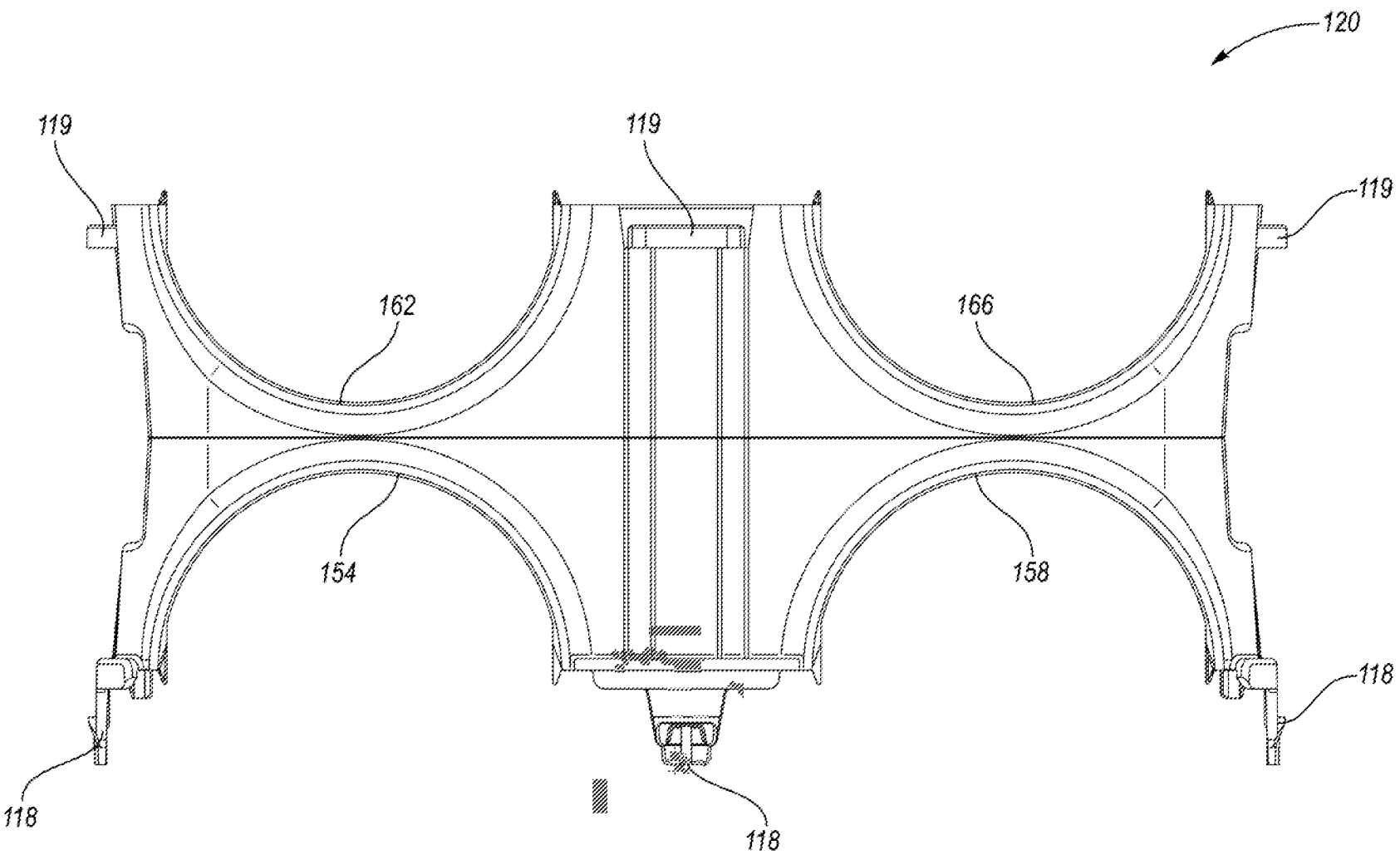
FIG. 12 is a side view of the adapter.

The first conduit 36, second conduit 40, third conduit 42, and fourth conduit 46 may each be connected to intermediate components or connecting parts such as a straight tube or conduit (e.g., horizontal conduit 20 and second horizontal conduit 24 in FIG. 1), reducing couplers, elbows, corrugate tube couplers (e.g., step-down couplers 41 that include clips 43 that are configured to engaged corrugated tubes, which are illustrated in FIG. 7), or any other desirable intermediate component or connecting part. If no connection is desired, a plug; a solid cap (e.g., caps 47 illustrated in FIG. 7) or cover; or a grate or grated cover may be secured to the first conduit 36, second conduit 40, third conduit 42, and fourth conduit 46. The first conduit 36, second conduit 40, third conduit 42, and fourth conduit 46 may each define lateral orifices 48 that are configured to receive pins 50 for securing such intermediate components or connecting parts to the first conduit 36, second conduit 40, third conduit 42, and fourth conduit 46.

The catch basin system 22 includes a basin 52 that is disposed between the first conduit 36 and the second conduit 40. The basin 52 is also disposed between the third conduit 42 and the fourth conduit 46. More specially, the basin 52 may be disposed between an outer or longitudinal end 53 of the first conduit 36 and an outer or longitudinal end 53 of the second conduit 40, and between an outer or longitudinal end 53 of the third conduit 42 and an outer or longitudinal end 53 of the fourth conduit 46. The basin 52 extends downward from the first conduit 36 and the second conduit 40. The basin 52 also extends downward from the third conduit 42 and the fourth conduit 46. The basin 52 intersects the first conduit 36, second conduit 40, third conduit 42, and fourth conduit 46.

The catch basin system 22 further includes an access port 54. The access port 54 is aligned along a third axis 56. The third axis 56 may be a substantially vertical axis (i.e., the third axis 56 may extend in a vertical direction). Substantially vertical may refer to any incremental angle that is between exactly vertical and 15° from exactly vertical. The third axis 56 may also be substantially perpendicular to the first axis 38 and to the second axis 44. Substantially perpendicular may refer to any incremental angle that is between exactly perpendicular and 15° from exactly perpendicular. The access port 54 is disposed above the basin 52. The access port 54 is disposed between the first conduit 36 and the second conduit 40. The access port 54 is also disposed between the third conduit 42 and the fourth conduit 46. More specially, the access port 54 may be disposed between the outer or longitudinal end 53 of the first conduit 36 and the outer or longitudinal end 53 end of the second conduit 40, and between the outer or longitudinal end 53 of the third conduit 42 and the outer or longitudinal end 53 of the fourth conduit 46. The access port 54 may be disposed between an outer lateral side 55 of the first conduit 36 and an outer lateral side 55 of the third conduit 42, and between an outer lateral side 55 of the second conduit 40 and an outer lateral side 55 of the fourth conduit 46. The access port 54 extends upward from the first conduit 36 and the second conduit 40. The access port 54 also extends upward from the third conduit 42 and the fourth conduit 46. The access port 54 intersects the first conduit 36, second conduit 40, third conduit 42, and fourth conduit 46.

The access port 54 may be coupled to any desirable intermediate component or connecting part, such as a straight conduit that may operate as a riser; a reducing coupler; an elbow; a corrugate tube coupler; a solid cap or cover; or a grate or grated cover; a pop-up drain emitter; or any other desirable connecting part component. Such a component or connecting part that is coupled to the access port 54 may engage an inner diameter of the access port 54 or an outer diameter of the access port 54. The outer diameter of the access port may include ribs 57 that are configured to engage a component or connecting part that is coupled to the access port 54.

The catch basin system 22 is configured to catch debris flowing within a drainage system (e.g., water drainage system 10). More specifically, the first conduit 36, second conduit 40, third conduit 42, fourth conduit 46, basin 52, and access port 54 may be portions of a common housing 58. The housing 58 may define an internal space or internal cavity 60 that is configured to catch the debris (e.g., dirt, leaves, shingle gravel, etc.) flowing within the drainage system 10. Even more specifically, a lower portion or sump 62 of the internal cavity 60 may be configured to catch the debris flowing within the drainage system 10 due to gravity and due to the position of sump 62 being along the bottom of the internal cavity 60. The sump 62 may more specifically be defined by the portion of the housing 58 that includes the basin 52 (e.g., the basin 52 may more specifically define the sump 62).

An upper portion 64 of the internal cavity 60 is defined by the first conduit 36, second conduit 40, third conduit 42, fourth conduit 46, and access port 54. It is noted that the water may flow into and outer of the internal cavity 60 via the first conduit 36, second conduit 40, third conduit 42, fourth conduit 46, which partially define the upper portion 64 of the internal cavity 60, placing the sump 62 in an ideal position to catch debris. Internal surfaces of the internal cavity 60 that extend in different directions may be connected to each other by round surfaces (e.g., fillets) to facilitate flow through the internal cavity 60 and prevent turbulence of water flowing through the internal cavity 60.

The access port 54 may be configured to provide access to the basin 52. More specifically, access may be obtained to the sump 62 via the access port 54 for cleaning out the sump 62. More generally, the access port 54 may be configured to provide access to the internal cavity 60 for purposes such as cleaning out the internal cavity 60. The access port 54 may alternatively operate as an inlet to or as an outlet from the internal cavity 60.

The housing 58 may define a first channel 66 extending between opposing longitudinal ends 68 of the housing 58. The housing 58 may define a second channel 70 extending between the opposing longitudinal ends 68 of the housing 58. The second channel 70 may be spaced-apart from the first channel 66. The first channel 66 may more specifically be formed by the first conduit 36 and the second conduit 40. Alternatively, the first channel 66 may comprise a first channel and a second channel that are defined by the first conduit 36 and second conduit 40, respectively, where the first channel and the second channel are each aligned along the first axis 38. The second channel 70 may more specifically be formed by the third conduit 42 and the fourth conduit 46. Alternatively, the second channel 70 may comprise a third channel and a fourth channel that are defined by the third conduit 42 and the fourth conduit 46, respectively, where the third channel and the fourth channel are each aligned along the second axis 44. The first channel 66 may be substantially parallel with the second channel 70. Substantially parallel may refer to any incremental angle that is between exactly parallel and 15° from exactly parallel.

The sump 62 is defined and disposed between the opposing longitudinal ends 68 of housing 58. The sump 62 intersects the first channel 66 and the second channel 70. The sump 62 also extends downward from the first channel 66 and the second channel 70. The access port 54 defines an access space or opening 72. The access port 54 and access space or opening 72 are also disposed between the opposing longitudinal ends 68 of housing 58. The access port 54, or more specifically the access space or opening 72, also intersects the first channel 66 and the second channel 70. The access port 54 and access space or opening 72 are disposed above the sump 62 and extend upward from the first channel 66 and the second channel 70. The access space or opening 72 is configured to provide access to the sump. The access port 54 and the access space or opening 72 may be substantially perpendicular to the first channel 66 and the second channel 70. Substantially perpendicular may refer to any incremental angle that is between exactly perpendicular and 15° from exactly perpendicular.

A bottom of the basin 52 tapers from the first conduit 36 and the third conduit 42 toward a center 76 of the basin 52. The bottom of the basin 52 also tapers from the second conduit 40 and the fourth conduit 46 toward the center 76 of the basin 52. Stated in other terms the basin 52 has a flat central region 78 defined along the bottom of the basin 52 and sloped regions 80 that extend upward from the flat central region 78 and toward the first conduit 36, second conduit 40, third conduit 42, and fourth conduit 46. Stated in other terms, the sloped regions 80 may extend downward from the first conduit 36, second conduit 40, third conduit 42, and fourth conduit 46 and toward the flat central region 78.

The sloped regions 80 may include upper sloped portions 82 extending downward from the first conduit 36, second conduit 40, third conduit 42, and fourth conduit 46; lower sloped portions 84 extending downward to the flat central region 78; and intermediated sloped portions 86 that are disposed between the upper sloped portions 82 and the lower sloped portions 84. The grade or gradient of the intermediated sloped portions 86 may be smaller than the grades or gradients of the upper sloped portions 82 and the lower sloped portions 84 (e.g., angles between the intermediated sloped portions 86 and a horizontal plane may be smaller than angles between either the upper sloped portions 82 or the lower sloped portions 84 and such a horizontal plane).

Protrusions 88 may extend downward from a bottom surface of the basin 52 along the flat central region 78. The protrusions 88 may define recessed regions 90 that extend upward. The recessed regions 90 may be configured to guide drill bits for adding drain holes to the bottom surface of basin 52. The protrusions 88 may also act as feet for supporting the catch basin system 22 in an upright position, which is desirable for storage and for when the catch basin system 22 is placed into use (e.g., when the catch basin system 22 is placed into a trench and connected to other portions of a drainage system).

The catch basin system 22, or more specifically the housing 58, may be formed as several components that are in turn secured to each other to form the catch basin system 22. For example, a bottom portion 92 of the first conduit 36, a bottom portion 94 of the second conduit 40, a bottom portion 96 of the third conduit 42, a bottom portion 98 of the fourth conduit 46, and the basin 52 may be formed as a first integrated component 100, which is part of the catch basin system 22 (or more specifically is part of the housing 58), while a top portion 102 of the first conduit 36, a top portion 108 of the second conduit 40, a top portion 110 of the third conduit 42, a top portion 112 of the fourth conduit 46, and the access port 54 may be formed as a second integrated component 114, which is part of the catch basin system 22 (or more specifically is part of the housing 58).

The first integrated component 100 may be secured to the second integrated component 114 by any known attaching method. For example, the first integrated component 100 may be secured to the second integrated component 114 by fasteners, screw, rivets, clamps, clips, snaps, tabs, etc. However, specific clipping or snapping features 116 may be integrally formed into the first integrated component 100 and the second integrated component 114. Such snapping features 116 may include flexible tabs or hooks 118 that engage loops 119. The tabs or hooks 118 may be integrally formed as part of either the first integrated component 100 or the second integrated component 114 while the loops 119 may be integrally formed as part of the other of the first integrated component 100 or the second integrated component 114. The first integrated component 100 and the second integrated component 114 may be formed via a molding process such as injection molding and may be made from a material such as Polyvinyl Chloride (PVC) or other suitable material.

Referring to FIGS. 8-12, an intermediate or adapter component 120 and the catch basin system 22 with the addition of an adapter component 120 are illustrated. The adapter component 120 may be referred to as a third integrated component. The inclusion of the adapter component 120 adds two additional pairs of spaced-apart aligned tubes or conduits (e.g., see the first conduit 36/second conduit 40 combination or the third conduit 42/fourth conduit 46 combination) that may function as inlets or outlets to the internal cavity 60. Each additional pair of spaced-apart aligned tubes or conduits may collectively form a single tube or conduit that is intersected by a central or internal space 122 defined by the adapter component 120. Internal space 122 may form a central portion of internal cavity 60 and expand the volume of internal cavity 60 when the adapter component 120 is utilized. The adapter component 120 is disposed or sandwiched between the first integrated component 100 and the second integrated component 114 when utilized. Multiple adapter components 120 may be disposed or sandwiched between the first integrated component 100 and the second integrated component 114 with each additional adapter component adding two additional pairs of spaced-apart aligned tubes or conduits that may function as inlets or outlets to the internal cavity 60.

With the additional of the adapter component 120, the catch basin system 22 further includes a fifth tube or conduit 124, a sixth tube or conduit 126, a seventh tube or conduit 128, and an eighth tube or conduit 130. The fifth conduit 124 and the sixth conduit 126 are spaced-apart relative to each other. The fifth conduit 124 and the sixth conduit 126 are aligned and/or extend along a fourth axis 132. The fifth conduit 124 and the sixth conduit 126 may collectively form a single tube or conduit that is intersected by an intermediate component (e.g., the basin 52, access port 54, or central section of the adapter component 120) and may be collectively referred to as the third conduit or tube.

The fourth axis 132 may be a substantially horizontal axis (i.e., the fourth axis 132 may extend in a horizontal direction). Substantially horizontal may refer to any incremental angle that is between exactly horizontal and 15° from exactly horizontal. The fourth axis 132 may be substantially parallel with the first axis 38 and the second axis 44. Substantially parallel may refer to any incremental angle that is between exactly parallel and 15° from exactly parallel. The fourth axis 132 may also be substantially perpendicular to the third axis 56. Substantially perpendicular may refer to any incremental angle that is between exactly perpendicular and 15° from exactly perpendicular.

The seventh conduit 128 and the eighth conduit 130 are spaced-apart relative to each other. The seventh conduit 128 and the eighth conduit 130 are aligned and/or extend along a fifth axis 134. The seventh conduit 128 and the eighth conduit 130 may collectively form a single tube or conduit that is intersected by an intermediate component (e.g., the basin 52, access port 54, or central section of the adapter component 120) and may be collectively referred to as the fourth conduit or tube.

The fifth axis 134 may be a substantially horizontal axis (i.e., the fifth axis 134 may extend in a horizontal direction). Substantially horizontal may refer to any incremental angle that is between exactly horizontal and 15° from exactly horizontal. The fifth axis 134 may be substantially parallel with the first axis 38, the second axis 44, and the fourth axis 132. Substantially parallel may refer to any incremental angle that is between exactly parallel and 15° from exactly parallel. The fifth axis 134 may also be substantially perpendicular to the third axis 56. Substantially perpendicular may refer to any incremental angle that is between exactly perpendicular and 15° from exactly perpendicular.

Also, with the addition of the adapter component 120, the first conduit 36, the second conduit 40, the third conduit 42, and the fourth conduit 46, among other portions of the catch basin system 22, are reconfigured. More specifically, (i) a bottom portion 136 of the first conduit 36, a bottom portion 138 of the second conduit 40, a bottom portion 140 of the third conduit 42, a bottom portion 142 of the fourth conduit 46 and the basin 52 are formed as the first integrated component 100; (ii) a top portion 144 of the fifth conduit 124, a top portion 146 of the sixth conduit 126, a top portion 148 of the seventh conduit 128, a top portion 150 of the eighth conduit 130, and the access port 54 are formed as the second integrated component 114; and (iii) a top portion 152 of the first conduit 36, a top portion 154 of the second conduit 40, a top portion 156 of the third conduit 42, a top portion 158 of the fourth conduit 46, a bottom portion 160 of the fifth conduit 124, a bottom portion 162 of the sixth conduit 126, a bottom portion 164 of the seventh conduit 128, a bottom portion 166 of the eighth conduit 130 are formed as a third integrated component (i.e., the adapter component 120).

The adapter component 120 may be secured to the first integrated component 100 and the second integrated component 114 in any manner describe herein, such via fasteners, screw, rivets, clamps, clips, snaps, tabs, etc. However, the clipping or snapping features 116 described above, which include tabs or hooks 118 that engage loops 119, may be integrally formed into the first integrated component 100, the second integrated component 114, and the third integrated component (i.e., the adapter component 120) so that the first integrated component 100, the second integrated component 114, and the third integrated component may be secured to each other. More specifically, the second integrated component 114 may include tabs or hooks 118 that engage loops 119 positioned along the top of the adapter component 120, or vice versa, and the adapter component 120 may include tabs or hooks 118 that engage loops 119 positioned along the top of the first integrated component 100, or vice versa.

That addition of the adapter component 120 also increases the size of the internal cavity 60 defined by the catch basin system 22. More specifically, the adapter component 120 defines the internal space 122, which forms a central portion of the internal cavity 60, and which is positioned between the lower portion (e.g., the sump 62) of the internal cavity 60 and the upper portion 64 of the internal cavity 60. The adapter component 120 may be formed via a molding process such as injection molding and may be made from a material such as Polyvinyl Chloride (PVC) or other suitable material.

The catch basin system 22 is an adaptable and versatile system that allows a user to increase or decrease the number of usable connections by adding or subtracting one or more adapter components 120 based on the desired need of the end user. Furthermore, the snapping features 116 allow for quick assembly and disassembly so the end user may easily and quickly configure or reconfigure the catch basin system 22 as desired.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A catch basin system comprising:

a first conduit aligned along a first horizontal axis;

a second conduit (i) spaced-apart from the first conduit and (ii) aligned along the first horizontal axis;

a third conduit aligned along a second horizontal axis;

a fourth conduit (i) spaced-apart from the third conduit and (ii) aligned along the second horizontal axis;

a basin (i) disposed between the first and second conduits, (ii) disposed between the third and fourth conduits, and (iii) extending downward from the first, second, third, and fourth conduits; and an access port (i) aligned along a vertical axis, (ii) disposed above the basin, (iii) disposed between the first and second conduits; (iv) disposed between the third and fourth conduits, (v) extending upward from the first, second, third, and fourth conduits, and (vi) configured to provide access to the basin, wherein (i) a bottom portion of the first conduit, a bottom portion of the second conduit, a bottom portion of the third conduit, a bottom portion of the fourth conduit and the basin are formed as a first integrated component and (ii) a top portion of the first conduit, a top portion of the second conduit, a top portion of the third conduit, a top portion of the fourth conduit, and the access port are formed as a second integrated component.

2. The catch basin system of claim 1, wherein the first horizontal axis and the second horizontal axis are aligned and spaced-apart horizontally.

3. The catch basin system of claim 1, wherein the access port is disposed between (i) a longitudinal end of the first conduit and a longitudinal end of the second conduit and (ii) a longitudinal end of the third conduit and a longitudinal end of the fourth conduit.

4. The catch basin system of claim 1, wherein the access port is disposed between (i) an outer lateral side of the first conduit and an outer lateral side of the third conduit and (ii) an outer lateral side of the second conduit and an outer lateral side of the fourth conduit.

5. The catch basin system of claim 1, wherein further comprising ribs protruding from an outer diameter of the access port, wherein the ribs are configured to engage a connecting part.

6. The catch basin system of claim 1, wherein first integrated component is secured to the second integrated component via snapping features.

7. A catch basin system comprising:

a first tube aligned along a first axis;

a second tube aligned along a second axis;

a basin (i) disposed between opposing ends of the first and second tubes, (ii) intersecting the first and second tubes, and (in) extending downward from the first and second tubes; and an access port (i) aligned along a third axis, (ii) disposed above the basin, (ii) disposed between opposing ends of the first and second tubes, (iv) intersecting the first and second tubes, (v) extending upward from the first and second tubes, and (vi) configured to provide access to the basin, wherein (a) a bottom portion of the first tube, a bottom portion of the second tube, and the basin are formed as a first integrated component and (b) a top portion of the first tube, a top portion of the second tube, and the access port are formed as a second integrated component.

8. The catch basin system of claim 7, wherein the first axis is substantially parallel with the second axis.

9. The catch basin system of claim 7, wherein the third axis is substantially perpendicular with the first axis and the second axis.

10. The catch basin system of claim 7, wherein the access port is disposed between an outer lateral side of the first tube and an outer lateral side of the second tube.

11. The catch basin system of claim 7, wherein further comprising ribs protruding from an outer diameter of the access port, wherein the ribs are configured to engage a connecting part.

12. A catch basin system comprising:

a first conduit aligned along a first horizontal axis;

a second conduit (i) spaced-apart from the first conduit and (ii) aligned along the first horizontal axis;

a third conduit aligned along a second horizontal axis;

a fourth conduit (i) spaced-apart from the third conduit and (ii) aligned along the second horizontal axis;

a basin (i) disposed between the first and second conduits, (ii) disposed between the third and fourth conduits, and (iii) extending downward from the first, second, third, and fourth conduits;

an access port (i) aligned along a vertical axis, (ii) disposed above the basin, (iii) disposed between the first and second conduits, (iv) disposed between the third and fourth conduits, (v) extending upward from the first, second, third, and fourth conduits, and (vi) configured to provide access to the basin; and fifth, sixth, seventh, and eighth conduits, wherein (i) a bottom portion of the first conduit, a bottom portion of the second conduit, a bottom portion of the third conduit, a bottom portion of the fourth conduit and the basin are formed as a first integrated component, (ii) a top portion of the fifth conduit, a top portion of the sixth conduit, a top portion of the seventh conduit, a top portion of the eighth conduit, and the access port are formed as a second integrated component, and (iii) a top portion of the first conduit, a top portion of the second conduit, a top portion of the third conduit, a top portion of the fourth conduit, a bottom portion of the fifth conduit, a bottom portion of the sixth conduit, a bottom portion of the seventh conduit, a bottom portion of the eighth conduit are formed as a third integrated component.

13. The catch basin system of claim 12, wherein the third integrated component is sandwiched between the first and second integrated components.

14. The catch basin system of claim 12, wherein the first horizontal axis and the second horizontal axis are aligned and spaced-apart.

15. The catch basin system of claim 12, wherein the access port is disposed between (i) a longitudinal end of the first conduit and a longitudinal end of the second conduit and (ii) a longitudinal end of the third conduit and a longitudinal end of the fourth conduit.

16. The catch basin system of claim 12, wherein the access port is disposed between (i) an outer lateral side of the first conduit and an outer lateral side of the third conduit and (ii) an outer lateral side of the second conduit and an outer lateral side of the fourth conduit.

17. The catch basin system of claim 12, wherein further comprising ribs protruding from an outer diameter of the access port, wherein the ribs are configured to engage a connecting part.

18. The catch basin system of claim 12, wherein first and second integrated components are secured to the third integrated component via snapping features.

19. A catch basin stem comprising:

a first tube aligned along a first axis;

a second tube aligned along a second axis;

a basin (i) disposed between opposing ends of the first and second tubes, (ii) intersecting the first and second tubes, and (iii) extending downward from the first and second tubes;

an access port (i) aligned along a third axis, (ii) disposed above the basin, (iii) disposed between opposing ends of the first and second tubes, (iv) intersecting the first and second tubes, (v) extending upward from the first and second tubes, and (vi) configured to provide access to the basin; and third and fourth tubes, wherein (i) a bottom portion of the first tube, a bottom portion of the second tube, and the basin are formed as a first integrated component, (ii) a top portion of the third tube, a top portion of the fourth tube, and the access port are formed as a second integrated component, and (iii) a top portion of the first tube, a top portion of the second tube, a bottom portion of the third tube, and a bottom portion of the fourth tube are formed as a third integrated component.

20. The catch basin system of claim 19, wherein the third integrated component is sandwiched between the first and second integrated components.

* * * * *